US005794387A

United States Patent [19]

Crookham

[11] Patent Number: 5,794,387

[45] Date of Patent: Aug. 18, 1998

[54] DEVICE AND METHOD TO LIFT AND MANIPULATE POLES WHICH ARE MOUNTED ONTO A BASE

[75] Inventor: Joe P. Crookham, Oskaloosa, Iowa

[73] Assignee: Musco Corporation, Oskaloosa, Iowa

[21] Appl. No.: 822,278

[22] Filed: Mar. 20, 1997

[51] Int. Cl.[6] ..... F04H 12/34

[52] U.S. Cl. ..... 52/122.1; 52/123.1; 52/741.1; 52/745.17; 52/749.1

[58] Field of Search ..... 52/111, 122.1, 52/123.1, 749.1, 741.1, 745.17

[56] References Cited

U.S. PATENT DOCUMENTS

| | | | |
|---|---|---|---|
| 1,679,297 | 7/1928 | Ehrler . | |
| 2,040,010 | 5/1936 | McMahon . | |
| 2,510,717 | 6/1950 | Roos . | |
| 2,792,947 | 5/1957 | Weedman . | |
| 2,985,261 | 5/1961 | Kubesh | 52/122.1 X |
| 2,998,106 | 8/1961 | Aust | 52/111 X |
| 3,355,847 | 12/1967 | Pratt . | |
| 3,364,635 | 1/1968 | Guggemos . | |
| 3,638,433 | 2/1972 | Sherard . | |
| 3,713,262 | 1/1973 | Jatcko . | |
| 3,911,548 | 10/1975 | Perry . | |
| 4,033,080 | 7/1977 | Fukushima . | |
| 4,272,929 | 6/1981 | Hanson . | |
| 4,327,534 | 5/1982 | Mastalski et al. | 52/122.1 |
| 4,492,496 | 1/1985 | Arnold . | |
| 4,779,389 | 10/1988 | Landers . | |
| 4,878,160 | 10/1989 | Reneau et al. . | |
| 4,903,442 | 2/1990 | Trommen . | |
| 5,398,478 | 3/1995 | Gordin et al. . | |

FOREIGN PATENT DOCUMENTS

| | | |
|---|---|---|
| 876891 | 11/1942 | France . |
| 2255713 | 5/1974 | Germany . |
| 2708664 | 9/1977 | Germany . |
| 53-16479 | 2/1978 | Japan . |
| 862350 | 3/1961 | United Kingdom . |
| 2 205 392 | 6/1988 | United Kingdom . |

OTHER PUBLICATIONS

Centrecon Sportsliner II/50 (Brochure) (Prior to Feb. 6, 1991) 4 pages.

Centrecon, Inc., FL Series Floodlighting (Brochure) (Prior to Feb 2, 1991), 2 pgs.

Union Metal Corporation; *Abacus–raising and lowing lighting columns 3m to 35m height*; Printed in England; 1985, Abacus Municipal Ltd.—(13 pg. brochure).

*Primary Examiner*—Christopher Kent

*Attorney, Agent, or Firm*—Zarley, McKee, Thomte, Voorhees, & Sease

[57] ABSTRACT

An apparatus and method for manipulating a pole relative to a base fixed in the ground. The base is gripped and provides a rigid reference point. The pole is cradled and an actuator provides force to move the pole relative to the reference point. This can include detaching the pole from the base as well as inserting the pole on the base. As an optional feature, a pivot mechanism can be associated with the combination to allow the pole to be pivoted with respect to the base to lower the pole for inspection and maintenance, or to erect the pole to be vertically aligned and then seated onto the base.

26 Claims, 11 Drawing Sheets

DEVICE AND METHOD TO LIFT AND MANIPULATE POLES WHICH ARE MOUNTED ONTO A BASE

INCORPORATION BY REFERENCE

The contents of U.S. Ser. No. 08/103,333 filed Aug. 6, 1993, now issued U.S. Pat. No. 5,398,478 on Mar. 21, 1995, including written description and drawings are incorporated by reference herein.

BACKGROUND OF THE INVENTION

A. Field of the Invention

The present invention relates to an apparatus and method for manipulating a pole or column including, for example, those shown, described, and claimed in U.S. Ser. No. 08/103,333, now issued U.S. Pat. No. 5,398,478 on Mar. 21, 1995. In particular, the invention relates to raising a pole or column with respect to a stabilized structure, for example, a base fixed in the ground, for purposes of erecting the pole or column onto the stabilized structure or removing the pole or column from the stabilized structure for a variety of reasons including construction of the pole or column, maintenance to the pole or column or anything elevated by the pole or column, and the like.

B. Problems in the Art

A variety of tasks are accomplished by poles or columns of substantial height. Examples are street and highway lights, sports field lights, utility wires, signs, to name but a few. Many such poles are of substantial height, for example, 30 to over 100 feet tall and therefore it is not trivial to handle such poles or columns, erect them, or take them down.

In fact, the most conventional way to erect poles or columns involves permanently mounting the pole or column. An example is direct burial of the pole or column in the ground. In some instances concrete is used around the end of the pole in the ground. Another method involves forming a concrete base in the ground with bolts sticking up out of the concrete. The pole is then bolted down onto the base at ground level.

These basically permanently erected poles present maintenance problems with respect to items elevated on the pole or column. Maintenance workers must either climb the pole or be lifted by such things as cherry pickers or cages and cranes. Such work is difficult and even dangerous, especially at substantial heights. At a minimum it is hard to convey workers and parts to such heights and then accomplish maintenance or work on the fixtures. Such procedures also generally involve substantial amounts of worker time and equipment cost.

Attempts have been made to deal with such problems. Patents such as U.S. Pat. Nos. 4,450,507; 4,181,929; and 4,220,981 utilize extendible poles or towers that can be raised and lowered on command. Most of these devices, however, relate to portable lighting systems, as opposed to permanent systems. The cost of such devices is substantial as are the associated components required to raise and lower the pole. They are not practical for permanent lighting applications.

U.S. Pat. Nos. such as 4,237,530 and 4,198,022 reveal what are called high-mast light support systems. Lights are connected to a frame that can essentially be raised and lowered along the pole for service and inspection. A fundamental problem with such systems is their complexity and durability because normally they require the use of cables and it is difficult to maintain rigidity of the fixtures if mounted to a moveable frame.

U.S. Pat. Nos. such as 4,903,442, 3,355,847, and 3,364,635, and Japanese 53-16479, disclose poles or columns which are hinged at or near ground level to allow the object suspended by the pole or column to be lowered for maintenance and inspection. These systems generally have some sort of releasable attachments such as bolts and a hinge mechanism built right into the pole or base. Such systems are generally handy but require additional structure and present rigidity problems. These systems are generally not adaptable for poles of substantial height.

UK published application 2,205,392A discloses a method of raising and lowering columns, including columns of substantial height. It discloses a device which receives the bottom of the pole or column and has a mechanism that mechanically applies force to raise the pole into position over a pre-existing concrete base with mounting bolts at ground level. The device can either be left in place to lower the pole upon release of the bolts, or the device can be removed and used for other poles or columns or be returned to the first mentioned pole or column if needed.

A problem with many of the prior art systems is also that special, additional structure has to be added to the pole to allow manipulation of the pole. Also that structure must be manipulated for and installed on each pole.

A system for designing and installing poles has been developed which is economical and efficient. Rather than using the conventional practices of direct burial of one end of the pole in the ground, or manufacturing a concrete base with upwardly extending bolts and bolting a pole to the base in the ground, the system utilizes a pre-designed, pre-manufactured base, of for example concrete, which can be placed in an excavated hole. Backfill can be added around the base. The upper end of the base extends several feet above ground level and preferably has a tapered end. The base can be plumbed and rigidly installed in the ground. Thereafter, a hollow pole can be slip-fit over the tapered base end above the ground. Because the base is plumb and rigid the pole will automatically be plumb.

Significant advantages of such a system include the ability to have the base installed ahead of time in the ground. The pole, usually hollow steel, is kept above the ground which greatly reduces moisture problems that can cause corrosion at ground level. Additionally, no fine adjustment regarding plumbing the pole is needed as is the case with direct burial poles or poles bolted to a concrete base formed in the ground. Also, the assurance of being vertically plumb means that items can be attached to the top of the pole while on the ground and then the whole pole with the attached objects can be elevated and slip-fit onto the base with the assurance that they will be in a known vertical location. The system also then allows rotation of the pole around the base for fine tuning of horizontal aiming or positioning the items at the top. This can be extremely valuable when elevating pre-aimed lighting fixtures such as used for example for sports fields. Such a system is disclosed in co-owned, co-pending U.S. Ser. No. 08/103,333, filed Aug. 6, 1993, now issued U.S. Pat. No. 5,398,478 on Mar. 21, 1995, entitled "Means and Method for Rigidly Elevating a Structure", filed Aug. 6, 1993 which is incorporated by reference herein.

Such a system, however, generally requires a crane to lift the pole and seat it on the concrete base. Many times the top of the base is up to five to ten feet above the ground. A crane is also used to rotate the pole on the base for correct alignment. If the pole is ever required to be disassembled, a crane is also needed. As described previously, absent lifting the pole off the base with the crane and laying it down on the ground, maintenance for items at the top of the pole must be accomplished by climbing to the top or raising work persons to the top.

While the advantages of the immediately-above-described system are enormous, a need still exists to improve on the efficiency of erection of a pole on a base as well as removing the pole from the base. Particularly significant is the need for improvement in reducing the cost, time, and difficulty of inspection of items elevated by the pole or column and maintenance on those items. The need to improve on the efficiency and ease regarding manipulating of most poles or columns which are attached to bases in the ground or other stabilized structure also exists. The term "base" will refer to in-ground and other stabilized structures.

It is therefore a principle object of the present invention to provide an apparatus and method for manipulating a pole that is fitted to a base that is anchored in the ground, which improves over or solves the problems and deficiencies in the art.

Further objects and features of the present invention are:

1. The ability to manipulate the pole efficiently and with more ease than existing methods;
2. The ability to manipulate the pole more economically;
3. The ability to manipulate the pole more safely;
4. The ability to have a substantial amount of flexibility with regard to manipulation of the pole relative to the base;
5. The ability to more quickly manipulate the pole;
6. The ability to have reliable control of manipulation of the pole.
7. The avoidance of the need for special structure on the pole to facilitate manipulation of the pole.
8. Maintenance of strength and rigidity of connection between pole and base.

These and other objects, features, and advantages of the present invention will become more apparent with reference to the accompanying specification and claims.

SUMMARY OF THE INVENTION

The present invention relates to an apparatus and method for manipulating poles and columns to attach or disattach them to a base. The method includes creating a rigid, secure reference grip on the base, cradling the pole, and then providing force to the pole to manipulate it relative to the reference point of the base to either raise the pole off the base, or bring the pole down onto the base. An optional feature is to allow not only vertical movement of the pole relative to the reference point on the base, but also pivoting movement of the pole once raised off of the base so that it can be tilted or laid down for inspection, maintenance, or other reasons.

The apparatus according to the invention includes a gripping connection for gripping the base, a cradling connection for cradling the pole, and an actuator to effectuate movement of the pole relative to the base.

DETAILED DESCRIPTION OF THE PREFERRED EMBODIMENT

A. Overview

Figure 3:
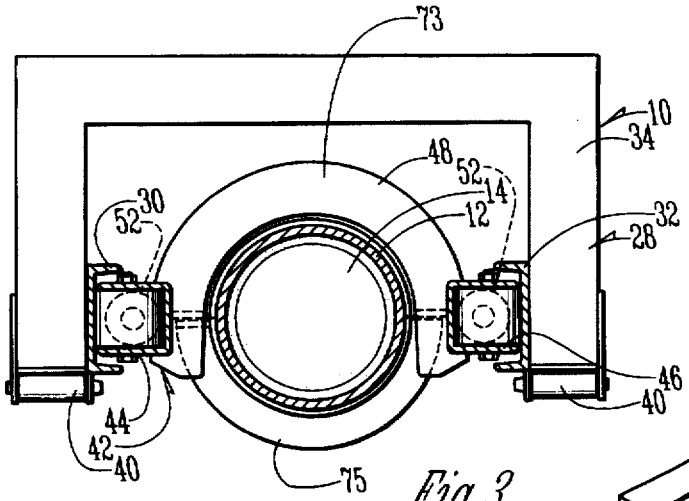
FIG. 3 is a sectional view taken along line 3—3 of FIG. 1.

To assist in a better understanding of the invention, a preferred embodiment will now be described in detail. The preferred embodiment will be discussed in the context of a pole which elevates a bank of pre-aimed lighting fixtures such as disclosed in U.S. Ser. No. 08/103,333, issued as U.S. Pat. No. 5,398,478 on Mar. 21, 1995. The pole is slightly tapered to slip-fit over a slightly tapered upward end of a concrete base that is rigidly installed in the ground, where the tapered end of the base is several feet above ground. It is to be understood, however, that the following description of a preferred embodiment of the invention is in the context of that type of pole and base arrangement only, but that the following description is not intended nor does it limit the scope of the invention as claimed.

Frequent reference will be made to the drawings. Reference numbers will be utilized to indicate certain parts and locations in the drawings. The same reference numbers will be used to indicate the same parts and locations throughout all of the drawings unless otherwise indicated.

Figure 1:
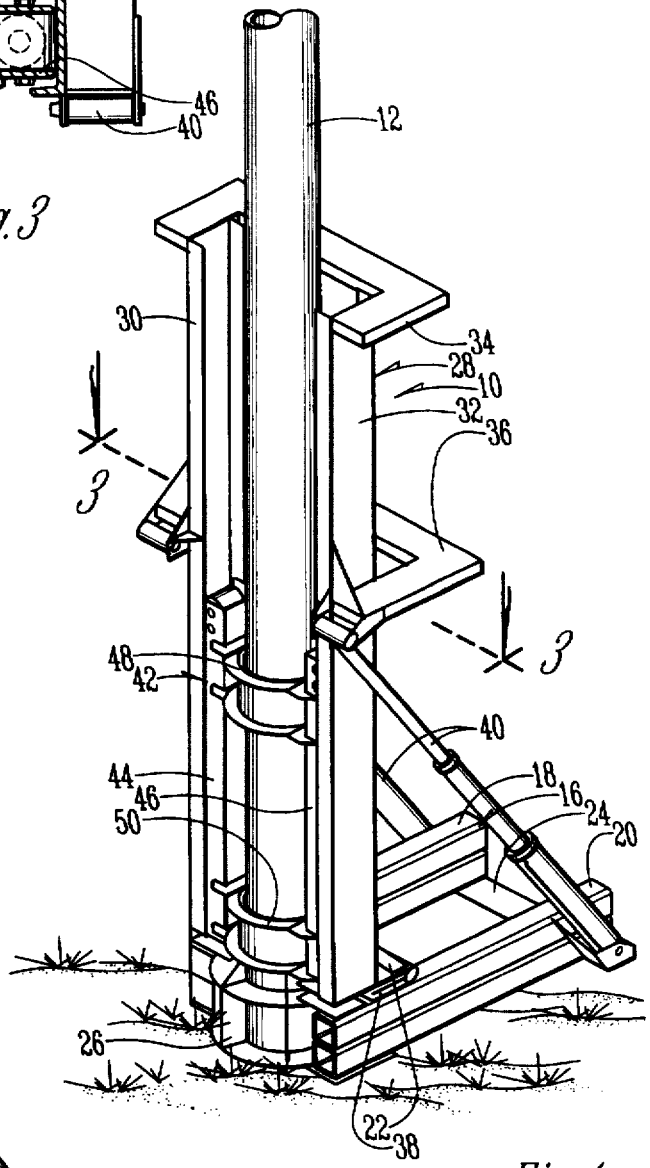
FIG. 1 is a perspective view of an embodiment of the invention as engaged with a pole and base.

FIG. 1 shows a device 10 according to the preferred embodiment in the invention engaged with a pole 12 which has been slip fit onto a base 14 (see FIG. 4) which is secured in the ground. The pole and base 12 and 14 can be, for example, of the type as disclosed in U.S. Ser. No. 08/103,333, now issued U.S. Pat. No. 5,398,478 on Mar. 21, 1995. Other types of poles and bases are also included within the scope of what the invention can be used with.

Device 10 includes lower frame 16 which extends along the ground. Lower frame 16 (approximately 5' long by 2½' wide) includes elongated beams 18 and 20 and cross beams 22 and 24. Most components of device 10 are made of metal.

A collar 26 is connected to the left ends of beams 18 and 20 in FIG. 1 and functions to provide a firm and stable grip of base 14. As will become more apparent, the grasping of base 14 by collar 26 provides the point of reference and stability for manipulation of pole 12. As will be described later, collar 26 is disassemblable to allow device 10 to be brought up to the pole/base 12/14, and then engaged to pole/base 12/14.

What will be called a tower 28 (approximately 10' tall) includes two elongated side rails 30 and 32 that are positioned to straddle opposite sides of pole and base 12/14. Cross braces 34 and 36 hold rails 30 and 32 in spaced apart parallel position but are U-shaped to allow pole 12 to be centered between rails 30 and 32. As will be described in more detail later, the bottom of tower 28 is pivotably attached by pivots 38 to lower frame 16 to allow tower 28 to be tilted downwardly from vertical over lower frame 16. Hydraulic cylinders 40 facilitate the tilting action of tower 28.

What will be called carriage 42 is positioned to slide within rails 30 and 32. It consists of first and second shuttles 44 and 46 which matably nest within facing channels in rails 30 and 32. Top and bottom collars 48 and 50 connect shuttles 44 and 46. Each collar 48 and 50 is disassemblable to surround pole 12 at spaced apart positions and cradle it.

Device 10 therefore, when engaged with pole 12 and base 14, utilizes collars 48 and 50 to cradle pole 12 at its bottom end (collar 50) and at a position spaced above the bottom end (collar 48). Collar 26 grips base 14. It is important to understand that collars 48 and 50 do not clamp pole 12 to the extent that there would be substantial radial pressure to pole 12. This is because radial pressure would work against the object of the invention because such clamping action would tend to lock the pole 12 onto base 14. Therefore, collars 48 and 50 completely surround pole 12 and essentially cradle it. Pole 12 can therefore not move in any lateral direction. As will be described in more detail later, in this embodiment collar 50 includes structure which supports the lower edge of pole 12. By this structure pole 12 can be moved vertically and the bottom of pole 12 can be supported during all movement without requiring any clamping or radial pressure to be exerted to pole 12 by collars 48 and 50. Therefore, collars 48 and 50 have an inside diameter which is no smaller than and usually slightly bigger than the outside diameter of pole 12 at the respective positions. It is to be understood that inserts or sleeves of different radial thicknesses can be used with collars 48 and 50 to accommodate different pole diameters.

Figure 2:
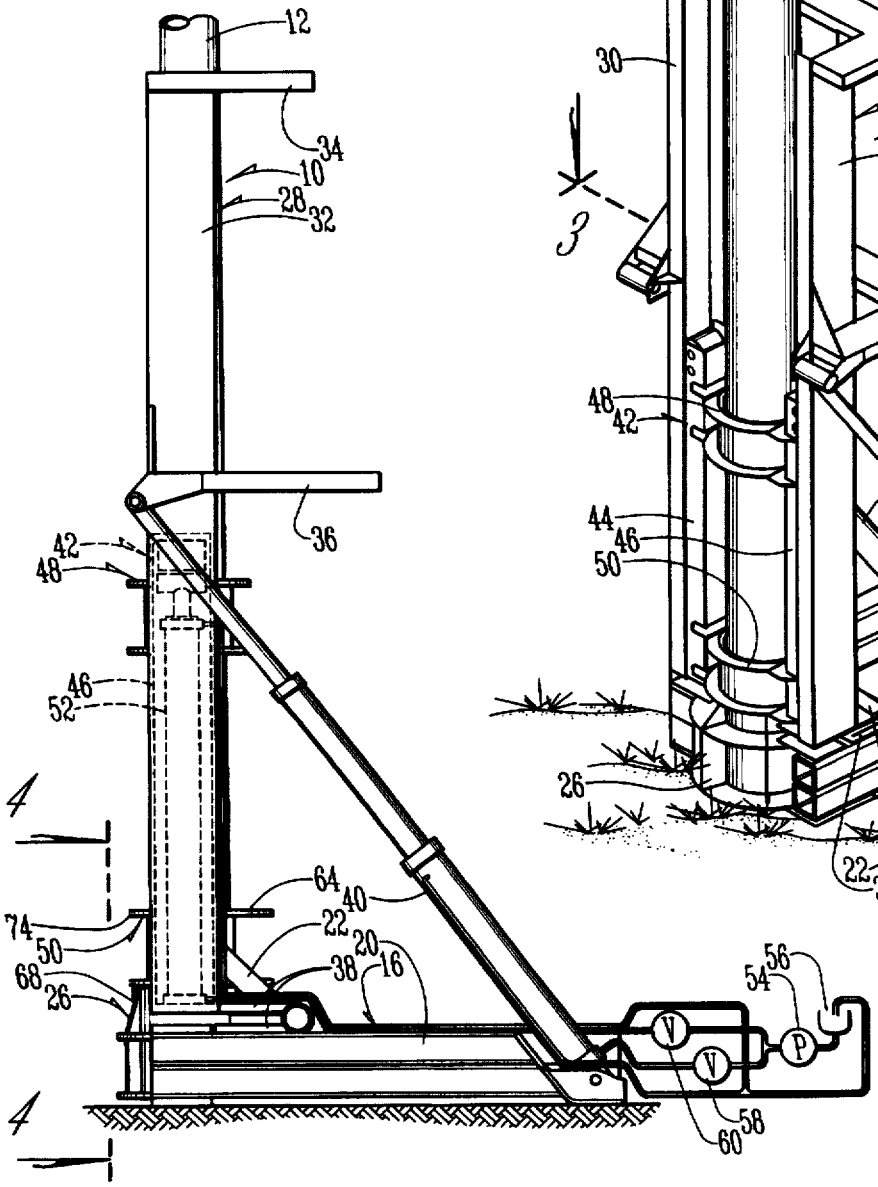
FIG. 2 is a side elevational view of FIG. 1, further showing diagrammatically connection to a source of hydraulic power.

As shown in FIGS. 2 and 3, hydraulic cylinders (4" bore) 52 are positioned inside shuttles 44 and 46 and serve to manipulate and move carriage 42 slideably within rails 30 and 32. FIG. 2 diagrammatically depicts hydraulic pump 54, hydraulic reservoir 56, and valves 58 and 60 which can be used to operate cylinders 40 and 52.

Figure 4:
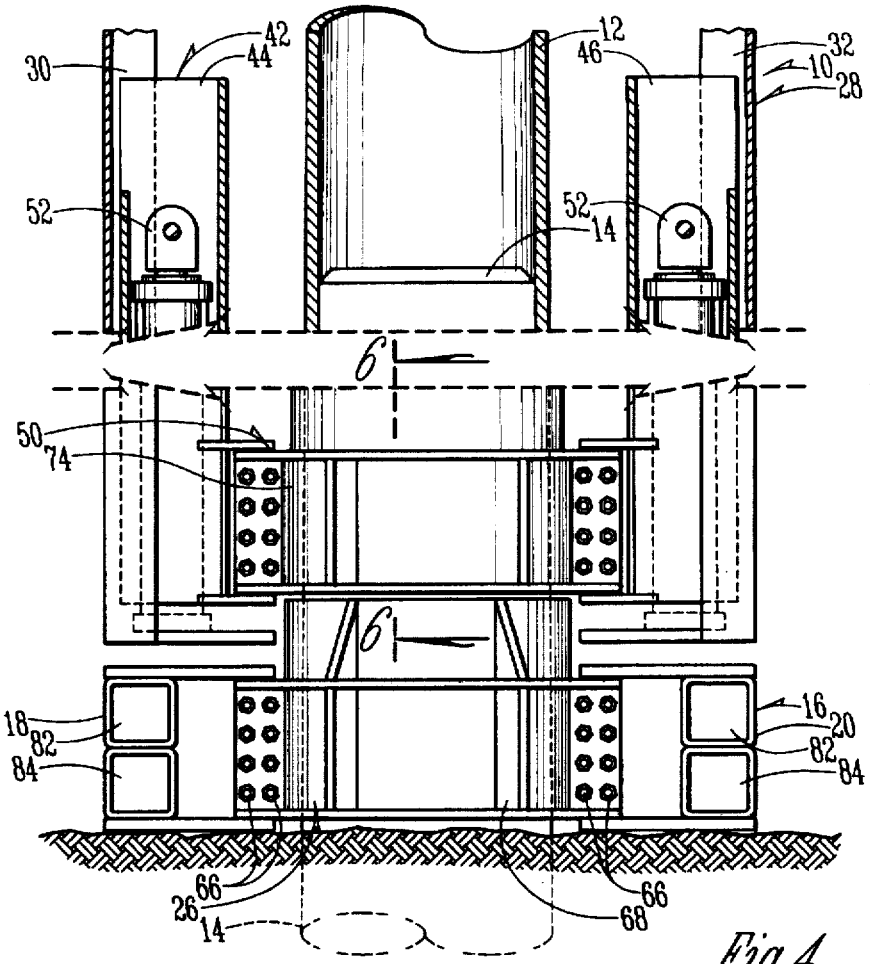
FIG. 4 is an enlarged elevational view taken along line 4—4 of FIG. 2.
Figure 5:
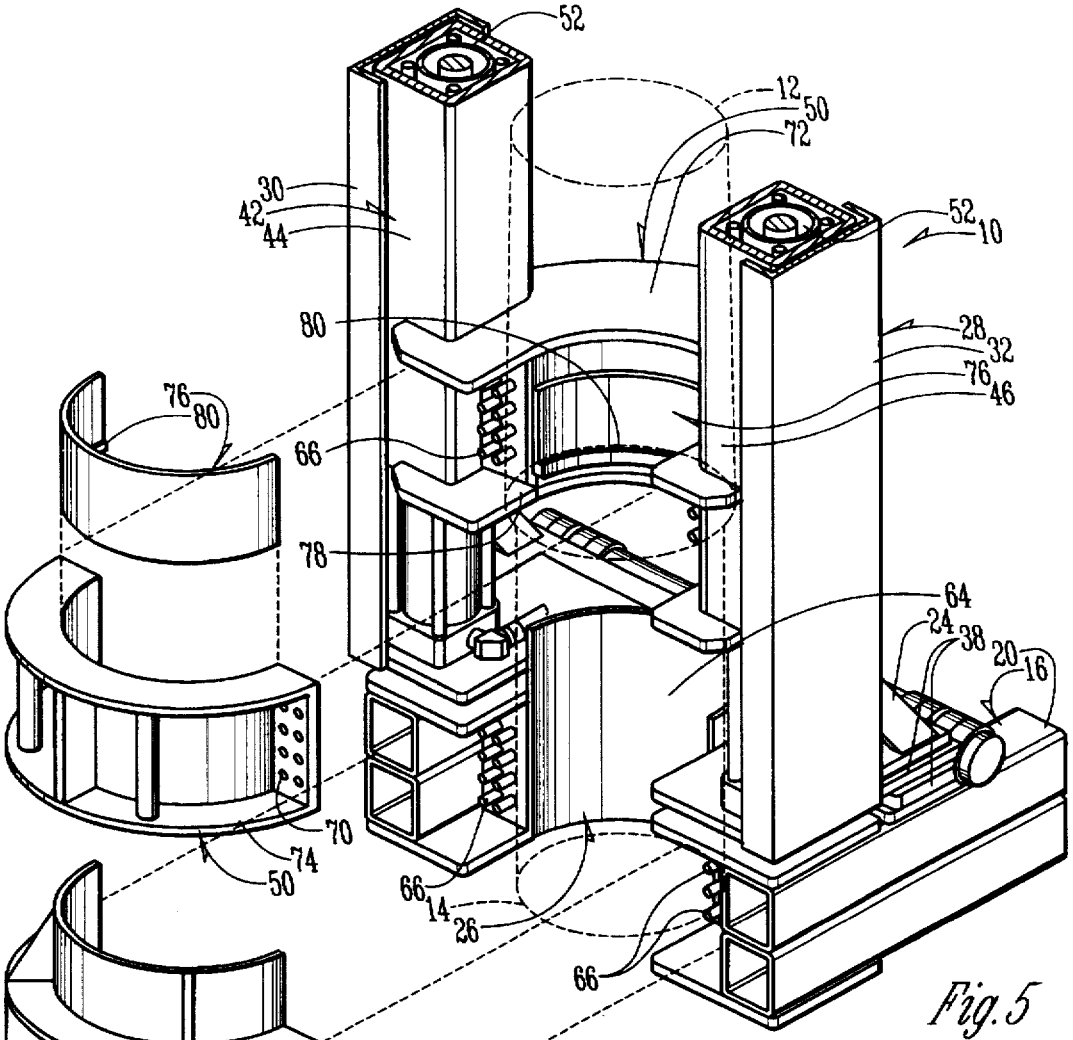
FIG. 5 is an enlarged perspective view of the bottom of the device of the embodiment of FIG. 1 showing in more detail the collars which grip the base and cradle the pole, in partially exploded view.
Figure 6:
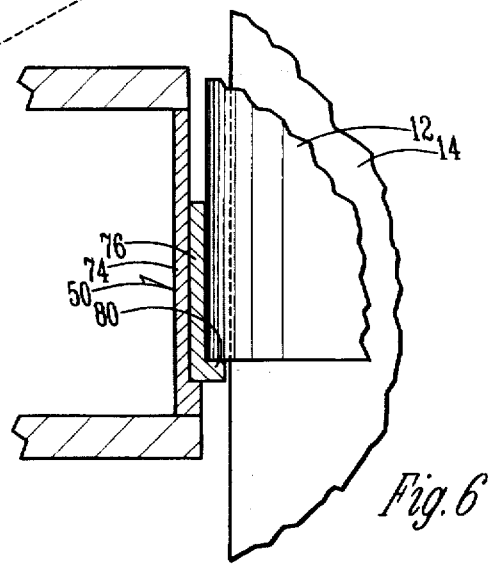
FIG. 6 is an enlarged sectional view taken along line 6—6 of FIG. 4.

FIGS. 4–6 show in more detail the collars and how they grip base 14 and pole 12. Each of collars 26, 48, and 50 (made of metal) is disassemblable into two generally 180° parts. Collar 26 has a first portion 64 which is rigidly attached to beams 18 and 20. Its inside diameter is designed to be slightly smaller than the diameter of base 14. A plurality of threaded studs 66 extend from collar half 64. The other half of collar 26 (reference numeral 68) has a plurality of apertures 70 which mate with studs 66. Nuts (see FIG. 4) are then threaded onto the ends of studs 66 when collar half 68 is mounted to collar half 64 to secure it in place. Once in place, collar 26, in combination with lower frame 16 provides a rigid place from which manipulation of pole 12 can be accomplished.

It is to be understood that lower collar 26 does tightly grip base 14. This is accomplished by tightening collar half 68 towards collar half 64 to clamp device 10 to base 14. It is to be understood that sleeves or inserts (see e.g. sleeve 76 of FIG. 5) could be utilized in the interior of collar 26 to accommodate different diameters of base 14, or different sized collar halves 68 could be utilized to fit different diameter bases 14. Collar 26 therefore not only surrounds base 14 so that no lateral movement of device 10 can occur but collar 26 also grips base 14 and basically uses the extreme strength and rigidity of base 14, and its securement in the ground, as the stabilizing structure from which pole 12 can be manipulated. Therefore, device 10 does not have to rely upon frame 16, rails 30 and 32, or any such structure for strength and stability to manipulate pole 12. In this embodiment, the upper end of base 14 is tapered, as previously described and as shown in U.S. Pat. No. 5,398,478. Thus, securely clamping of collar 26 along the upper end of base 14 not only radially grips base 14 at that location, but the inside diameter of collar 26 is smaller then the outside diameter of base 14 under that location. This prohibits downward moving or slipping of device 10 on base 14.

FIGS. 4–6 show that middle collar 50 has a first half 72 which is rigidly attached to shuttles 44 and 46. It likewise has studs 66 that fit into holes 70 in the other half 74 of collar 50. Collar 50 is the primary mechanism by which pole 12 is moved relative to base 14. It is important to understand that collar 50 surrounds pole 12 but does not exert significant radial inward pressure on pole 12, because it must not clamp pole 12 to base 14, or it would make it more difficult to separate them. It therefore cradles pole 12 at that location, as one function. A second function allows device 10 to lift and support pole 12. An inner collar or sleeve 76 (separable into two halves each corresponding to a half 72 and half 74 of collar 50) nests within collar 50 and rests against lower flange 78 of collar 50. Still further, sleeve 76 has a lower, inwardly extending lip 80. This lower lip is designed to fit underneath the lower edge of pole 12. In this embodiment, the main portion of sleeve 76 has an inside diameter which is slightly larger than the diameter of pole 12 at the point around which it surrounds. The inside diameter of lower lip 80, however, is less than the outside diameter of the very bottom of pole 12 (see FIG. 6). Lower flange 78 of collar 50 also has an inside diameter greater than the outside diameter of base 14 but serves to support sleeve 76 so that it can abut the lower edge of pole 12. When carriage 42 is vertically. moved, pole 12 must move with it. Conversely, if carriage 42 is lowered, lower lip 80 supports pole 12 and pole 12 can not move past it downwardly. Sleeve 76 can be made of poly-plastic. It is to be understood that sleeved 76 can be made of different sized for different poles. Also several sleeves 76, of decreasing diameter can be rested within one another so that the different sized poles can be serviced without changing the collars.

FIG. 6 shows in detail how lip 80 would engage the bottom of pole 12. Lip 80 allows force to be exerted against the bottom of pole 12, and to cradle the bottom of pole 12.

Upper collar 48 would be similar to middle collar 50 except it would not have a sleeve with a lower lip such as lower lip 80. It may receive a sleeve, but the entire inside diameter of collar 48 and any sleeve would be at least slightly greater than the outside diameter of pole 12 at that location because it does not have to lift pole 12. Collar 48 would cradle pole 12 at its location to prevent lateral movement or bending of pole 12, and furthermore to assist support of pole 12 if it is tilted from vertical. Collar 48 includes a half portion 73 (see FIG. 3) fixed to shuttles 44 and 46. A removeable half 75 (see FIG. 3), securable by bolts and nuts such as discussed previously regarding collar 50, would allow half 75 to be fastened to half 73 to surround and cradle pole 12.

Operation of the invention according to the above-described embodiment is as follows. Beams 18 and 20 of lower frame 16 can have channels 82 and 84 (see FIG. 4). A fork lift 86 could engage those channels and move device 10 to the proximity of pole/base 12/14 (see FIG. 7). Alternatively, lower frame 16 could be moved via a trailer or even be integrated with a trailer or vehicle. By removal of the collar halves that are detachable (collar halves 68, 74, and 75), device 10 can be brought towards pole/base 12/14 (see FIG. 8) so that pole/base 12/14 matably fits within the non-removable halves (64, 72, and 73) of collars 26, 50, and 48.

As shown in FIGS. 1–4 and 9, the removeable collar halves would then be bolted to the non-removeable halves. Lower collar 26 would be tightened to grip base 14. The middle collar 50 for pole 12 would be positioned so that lip 80 is underneath the bottom edge of pole 12.

Figure 9:
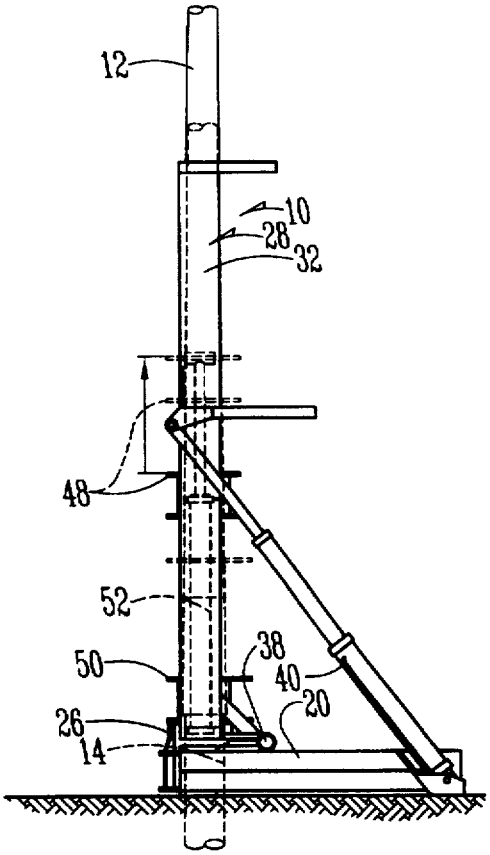
FIG. 9 is similar to FIG. 8 but shows the device attached to the pole and base and how it begins vertical movement of the pole relative to the base.

FIG. 9 then shows that hydraulic cylinders 52 would be operated to move carriage 42 upwardly to unseat pole 12 from its normal position on base 14 (see solid lines) and start moving it from base 14 in a vertical direction (see dashed lines).

Figure 10:
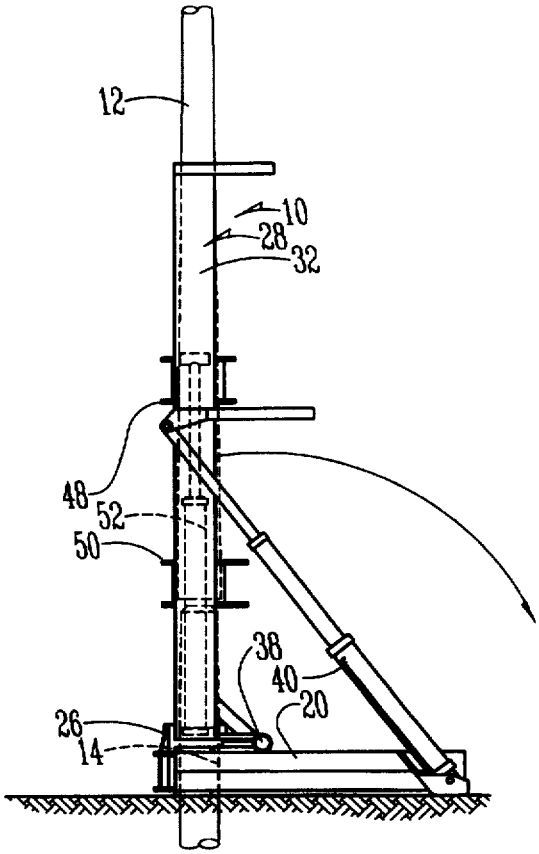
FIG. 10 is similar to FIG. 9 but shows vertical movement of the pole to a position above the base.

FIG. 10 shows that once the bottom edge of pole 12 clears the top of base 14 (usually by several inches at least), cylinders 40 can be operated to tilt tower 28 (which is holding the entire pole 12) in the direction of the arrow in FIG. 10.

Figure 11:
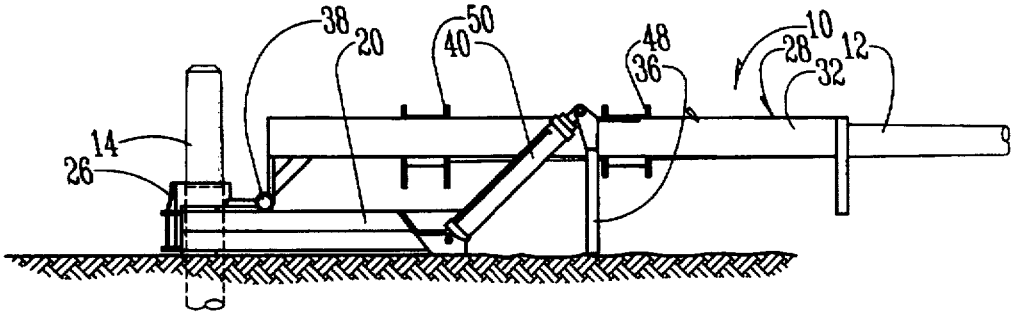
FIG. 11 is similar to FIG. 10 but shows the pole tilted down away from the base.

FIG. 11 shows that tower 28 can be pivoted all the way to horizontal. As can be easily understood, this would allow the easy maintenance or repair of whatever is suspended at the top of pole 12, such as lighting fixtures.

Figure 7:
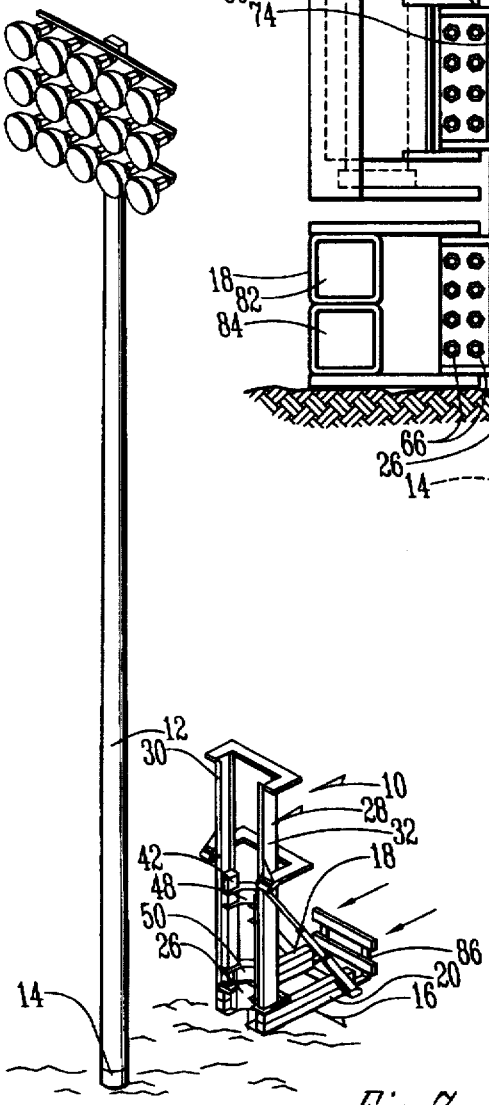
FIG. 7 is a perspective view of the embodiment of FIG. 1 shown spaced from a base and pole.
Figure 8:
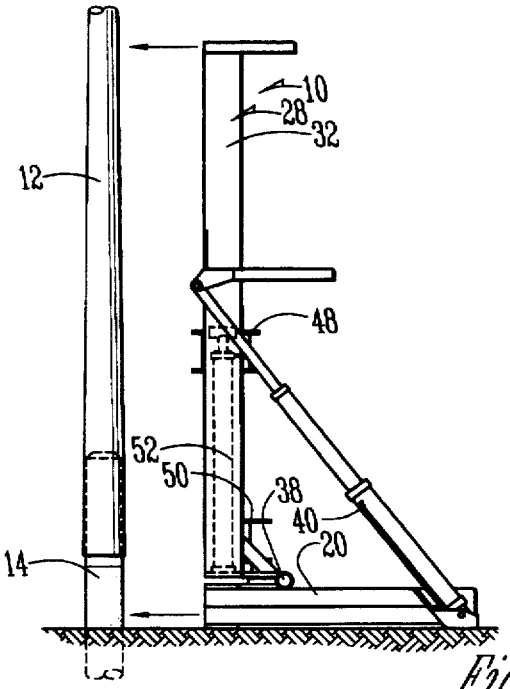
FIG. 8 is an enlarged side elevational view of FIG. 7 illustrating engagement of the device to the light pole and base.

As can also be easily understood, by reversing the process, beginning with FIG. 11, a pole 12 can be installed rigidly on base 14. The new pole can be laid into the non-detachable collar halves when the detachable collar halves are removed. Collar halves 75, 74, and 68 can then be installed on halves 73, 72, and 64 and tightened. Cylinders 40 can be operated to bring tower 28 to the vertical position in FIG. 10. Cylinders 52 can then be operated to lower pole 12 onto base 14 as shown in FIG. 9. Pole 12 can be completely lowered onto base 14 as shown in FIG. 8. The removable collar halves can be taken off, and device 10 can be moved away from the pole as shown in FIG. 7. Base 14, in this instance is made of concrete (other materials, such as steel, are possible), and has an upper end (see FIG. 8) which is slightly tapered, and a lower end.

Pole 12 can be slip-fit down onto top of base 14 for a secure and plumb mounting, as shown in FIG. 8. Various heights of pole 12 can be accomplished either by increasing the length of pole 12, or using multiple sections.

FIG. 7 shows a pole 12 with a bank of pre-installed and pre-aimed light fixtures, slip-fit onto base 14. The conventional way of doing so is to use a crane that has cable or cables connected to the top of pole 12. The lighting fixtures are generally installed on the ground and then pole 12 is raised by the crane from its top, moved over above base 14 and then slip-fit onto the top of base 14. As can easily be understood, utilization of large cranes of this type can be costly and time consuming.

Hydraulic cylinders 40 and 52 can be selected to adequately handle the weight of pole 12 and light fixtures as well as have sufficient travel to effectuate the complete removal of pole 12 from base 14. It is noted that device 10 could be mounted on a portable trailer or motor vehicle for easy transportation.

This combination is easily transported from pole to pole. The device 10 is easily connected and, with the use of hydraulics, provides sufficient force to even handle poles of substantial height and size bearing banks of fixtures or other objects. It allows quick, efficient manipulation of the pole relative to the base for a number of purposes, including inspection and maintenance. It also allows quick and efficient erection of a pole and any object connected thereto onto the base in the ground.

It will be appreciated that the present invention can take many forms and embodiments. The true essence and spirit of this invention are defined in the appended claims, and it is not intended that the embodiments of the invention presented herein should limit the scope thereof.

For example, the invention, as previously stated, is not limited to poles bearing arrays of lighting fixtures. It could be used for a number of types of poles or columns regardless of what they support or suspend. It is also not limited to bases having tapered upper ends and poles having tapers. It could be used in any situation where there is a rigid reference relative to the ground, and a connection to a hole that allows the pole to be moved relative to the reference.

The invention is also not limited to the utilization of hydraulic cylinders as actuators for manipulating the pole relative to the base or reference.

FIGS. 12–23 disclose another embodiment according to the invention. This embodiment will be referred to as device 100. Many of the features of device 100 will be similar or identical to that of device 10. Therefore, the same reference numbers will be used for the same or similar parts and locations. The following description will concentrate on the differences between device 100 and device 10.

Figure 12:
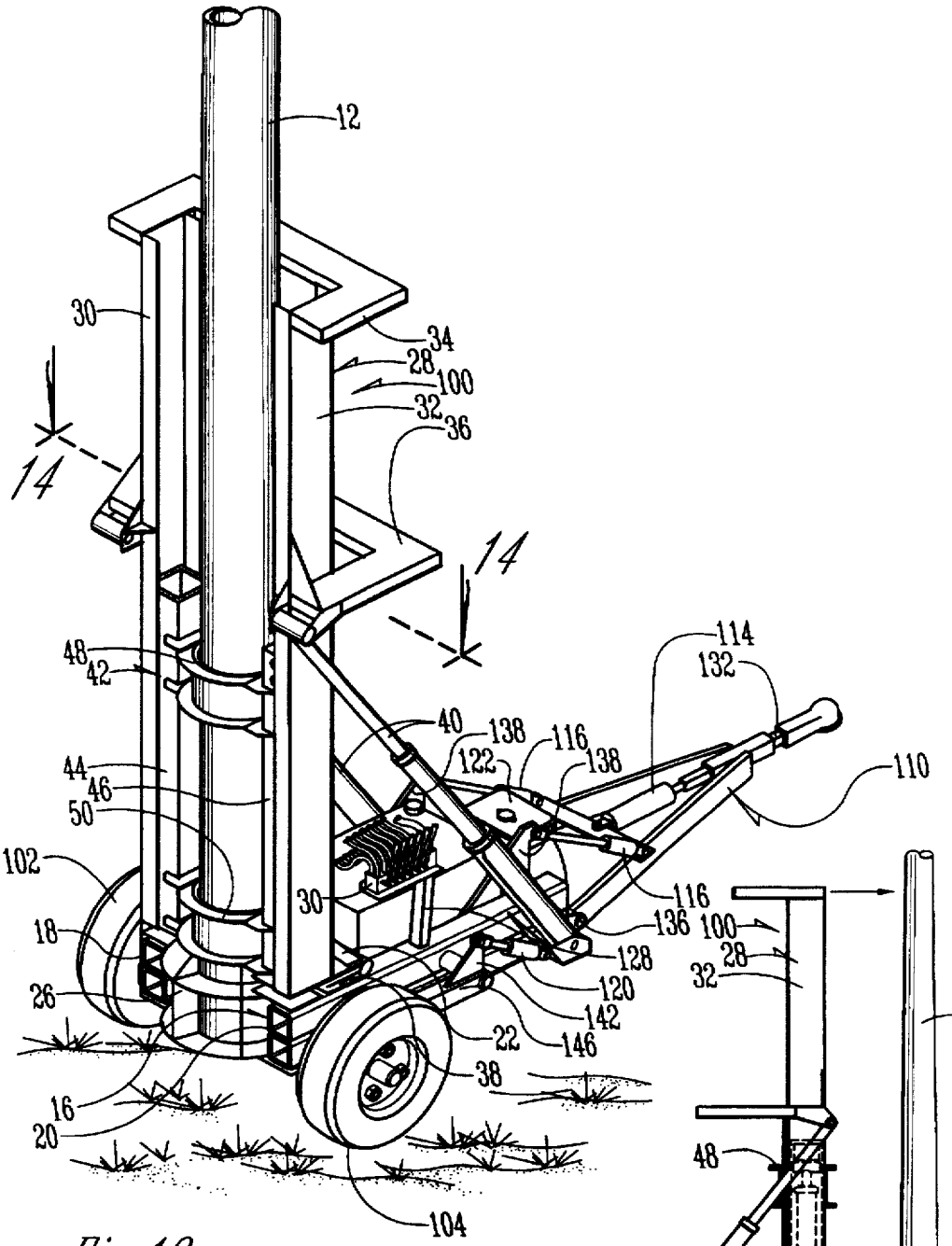
FIG. 12 is a perspective view similar to FIG. 1 illustrating another embodiment according to the present invention.
Figure 18:
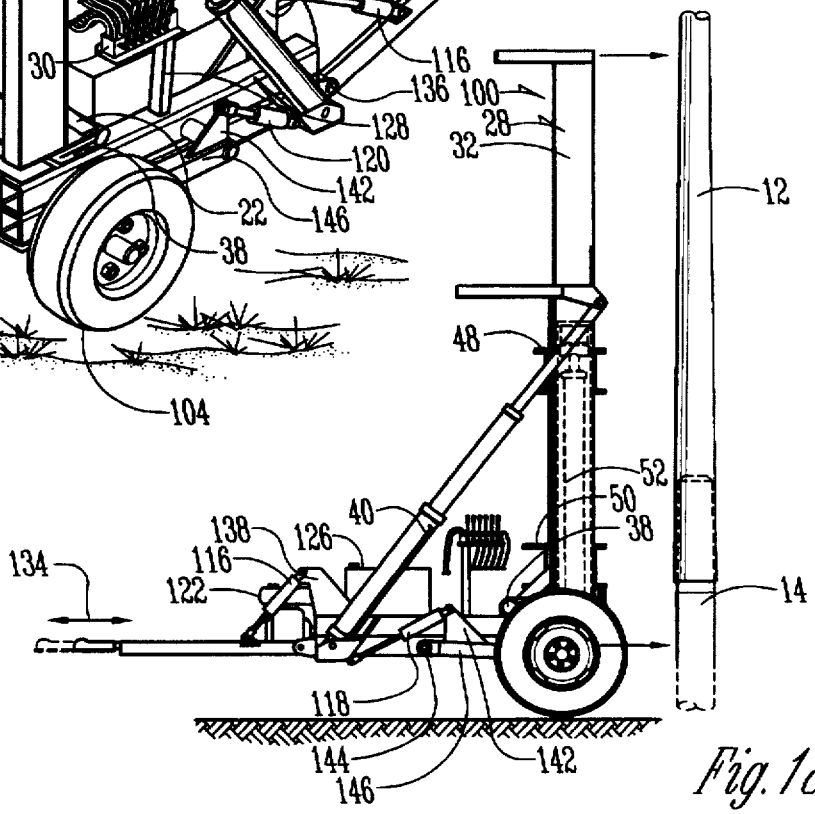
FIG. 18 is similar to FIG. 8 but shows the embodiment of FIG. 12 spaced from a pole and base on an opposite side of the pole from that of FIG. 8.
Figure 13:
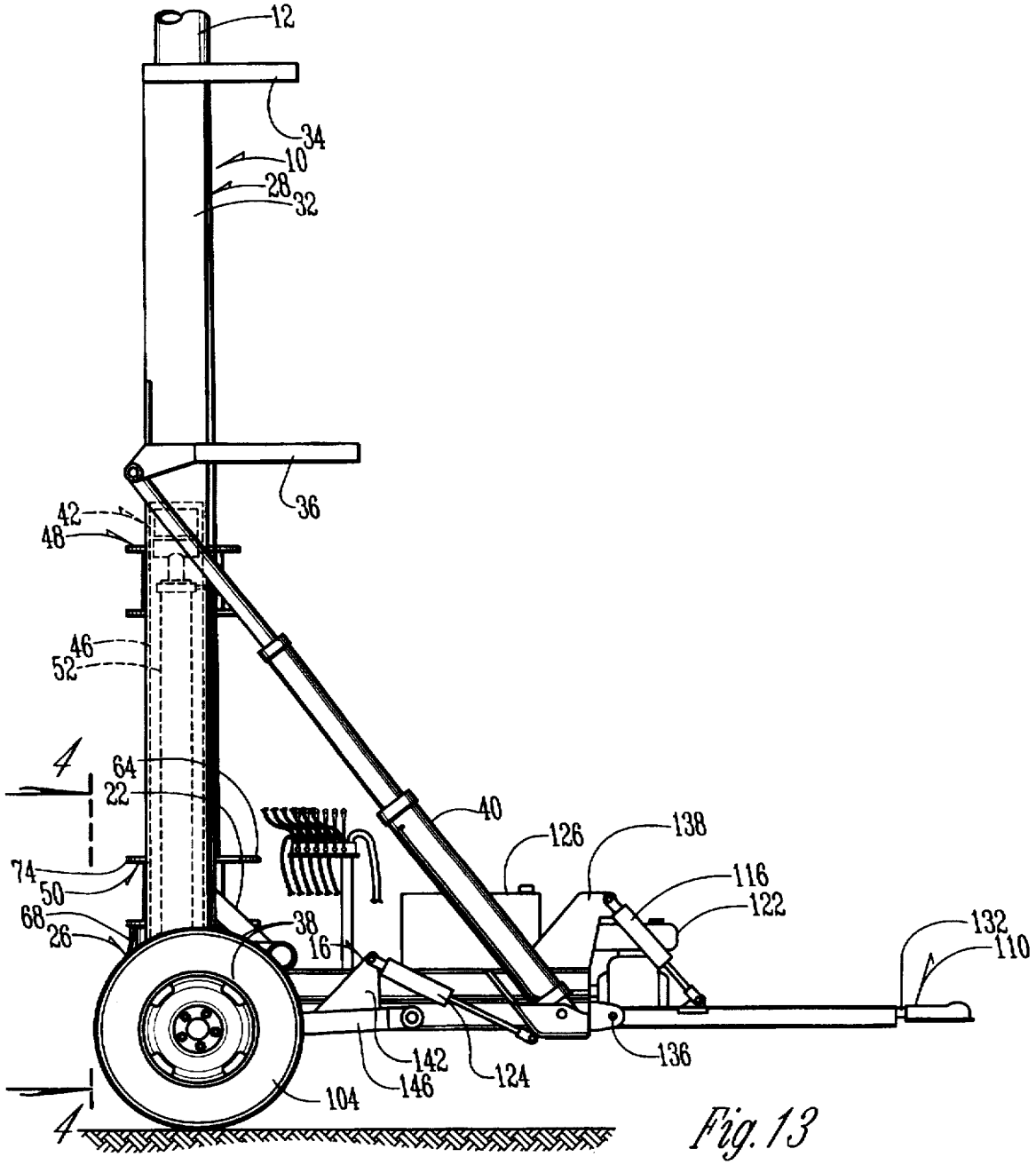
FIG. 13 is similar to FIG. 2 but shows the embodiment of the invention of FIG. 12.
Figure 17:
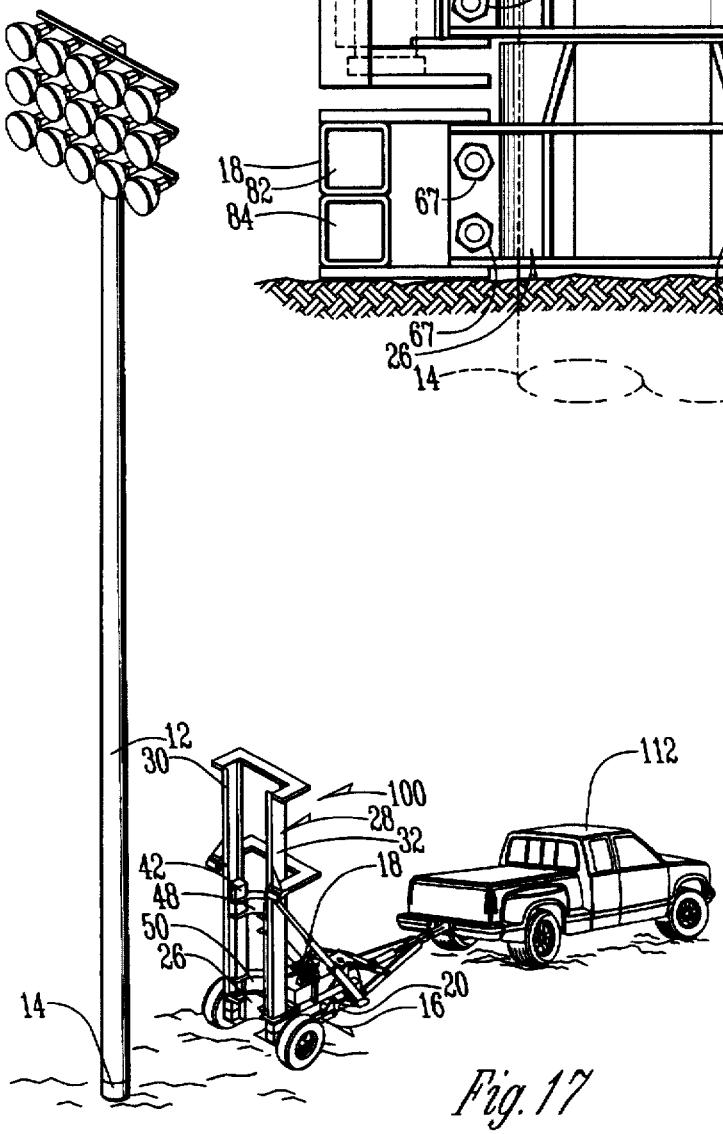
FIG. 17 is similar to FIG. 7 but shows the embodiment of FIG. 12 attached to a motor vehicle.
Figure 19:
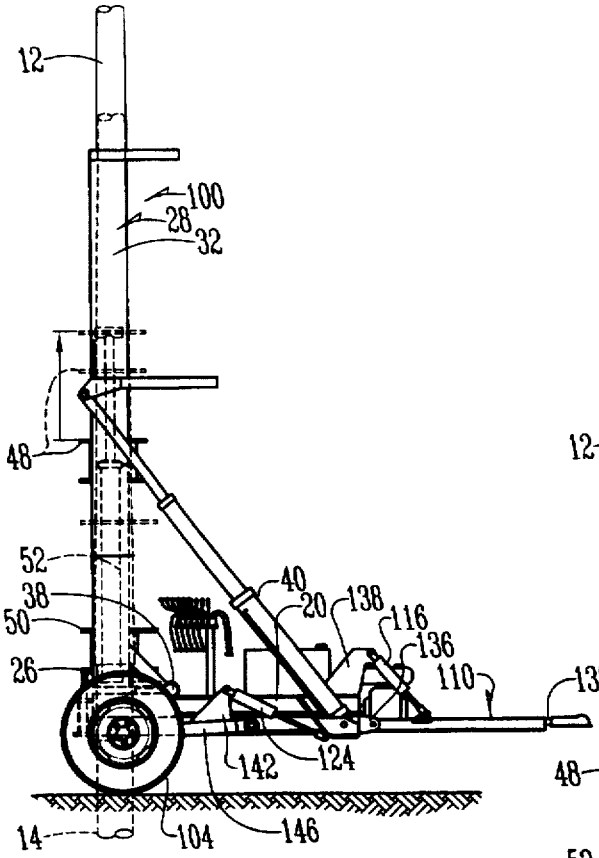
FIG. 19 is similar to FIG. 9 but shows the embodiment of FIG. 12.
Figure 20:
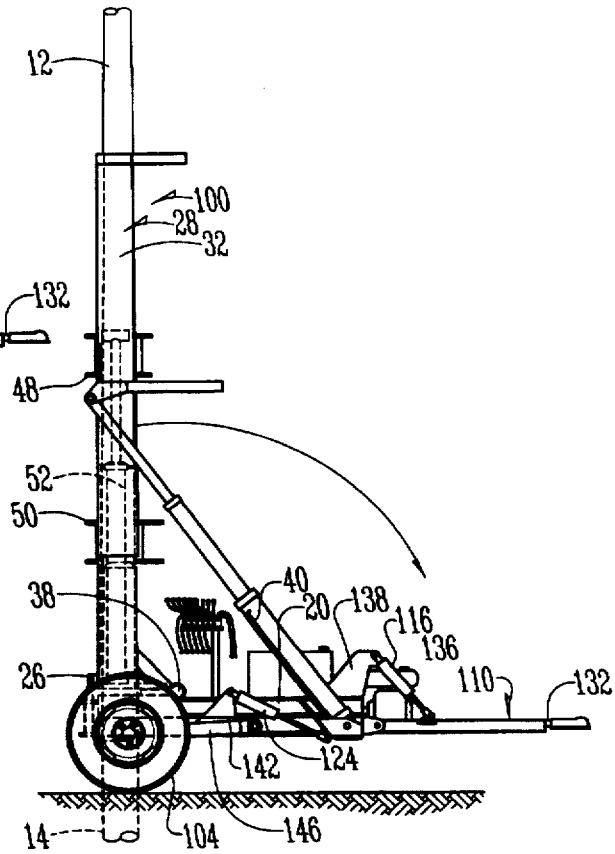
FIG. 20 is similar to FIG. 10 but shows the embodiment of FIG. 12.
Figure 21:
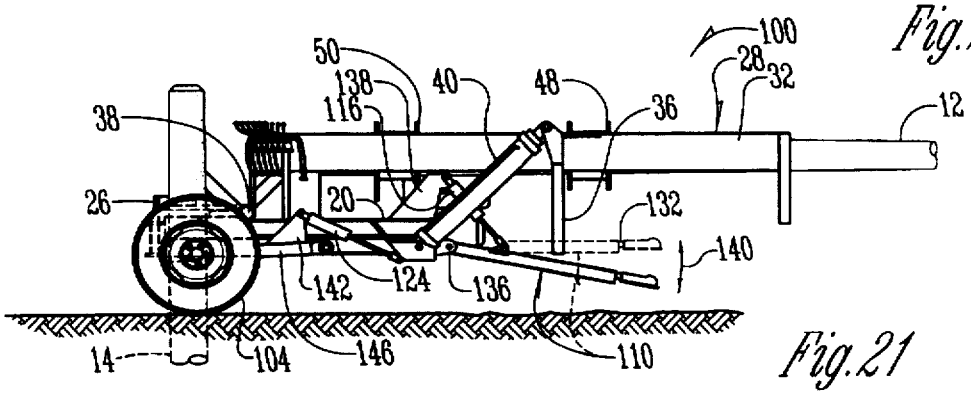
FIG. 21 is similar to FIG. 11 but shows the embodiment of FIG. 12.

As can be seen in FIG. 12, device 100 includes lower frame 16, masts 30 and 32, shuttles 44 and 46 and upper collar 48, middle collar 50, and lower collar 26. The major difference from device 10 is that device 100 includes self-contained wheels 102 and 104 and a trailer tongue 110. Device 100 is therefore mobile by connection of tongue 110 to a motor vehicle. As shown in FIGS. 17 and 18, vehicle 112 can back device 100 up to pole and base combination 12/14. The removable halves of collars 48, 50, and 26 can then be attached and can operate like device 10.

Device 100 also differs from device 10 in that additional hydraulic cylinders are utilized to provide adjustability features. A tongue extension cylinder 114 (FIG. 1) is connected to extendible tongue 132 and can move extendible tongue 132 in the direction shown by arrow 134 in FIG. 18; namely outwardly or inwardly. This helps in fine adjustment of the orientation of device 100 relative to pole/base 12/14 once device 100 is backed into proximity of pole/base 12/14. Tongue raising cylinders 116, are attached between tongue 110 and ears 138 (which are rigidly attached to lower frame 116). Tongue 110 is pivotably attached to lower frame 116 at reference numerals 136. Operation of cylinders 116 allows the entire tongue 110 to be tilted relative to device 110. This can help in orienting device 110 towards pole/base 12/14 when aligning device 110 for connection of the removeable collar halves. Cylinders 116 operate in unison in the direction shown by arrow 140 in FIG. 21. It can also be beneficial to orienting device 110 relative to pole and base 12/14 even after the vehicle has been disattached from tongue 110. For example, tongue 110 could be supported on the ground or some sort of block. By operating cylinders 116, masts 30 and 32 could be finely adjusted relative to pole and base 12/14.

Figure 22:
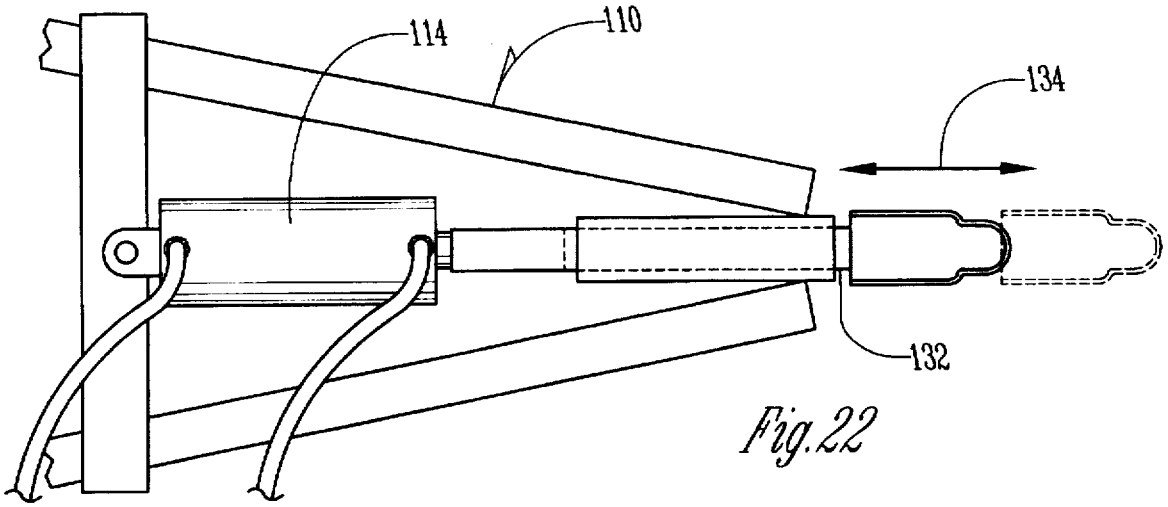
FIG. 22 is an enlarged top plan view of the tongue of the embodiment of FIG. 12.
Figure 23:
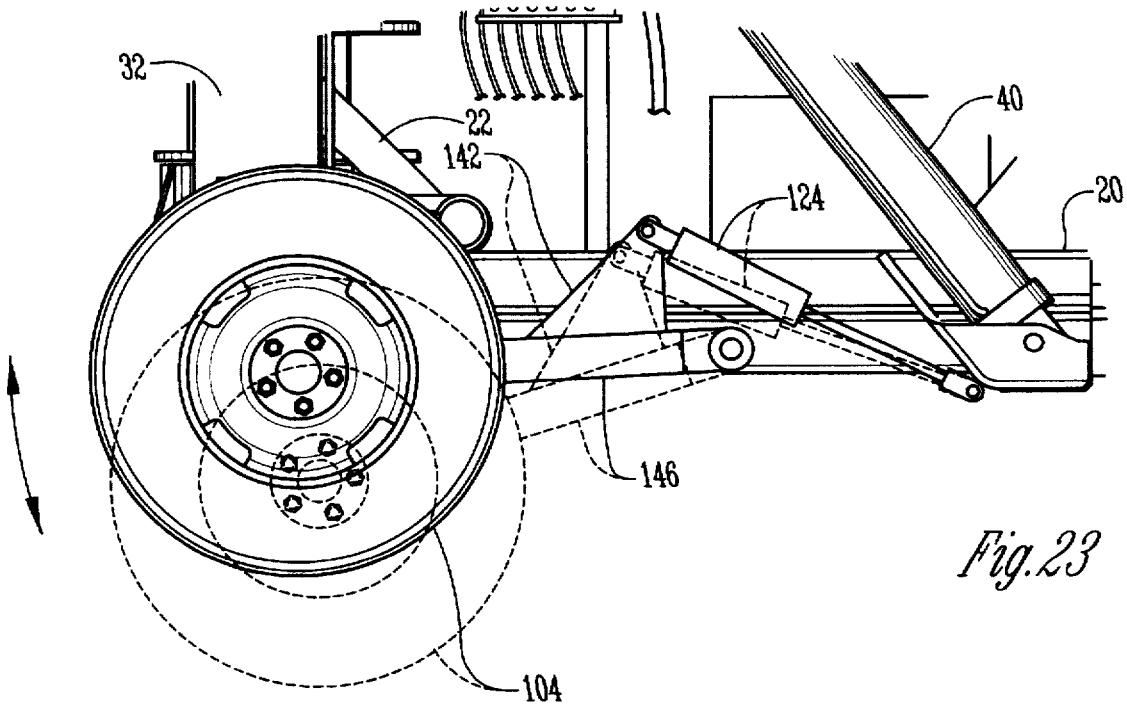
FIG. 23 is an enlarged partial side elevational view of the embodiment of FIG. 12.

Cylinders 118 and 120 are connected between frame 116 and ears 142, which in turn are connected to pivotable arms 146 (which pivot around pivot points 144). Arms 146 are in turn connected to wheels 118 and 120. This arrangement allows left and right wheels 104 and 106 to be vertically raised or lowered (see FIG. 23). This can also help orient device 100 relative to pole/base 12/14 to get precise alignment. FIG. 22 illustrates with more specificity the extendibility of tongue extension 132.

FIGS. 12, 13, 19–23 illustrate the components utilized with all the hydraulic cylinders used in device 100. It is to be understood that device 100, like device 10, utilizes cylinders 40 to tilt the mast between vertical and horizontal and cylinders 52 to lift carriage 42 along the mast.

Figure 24:
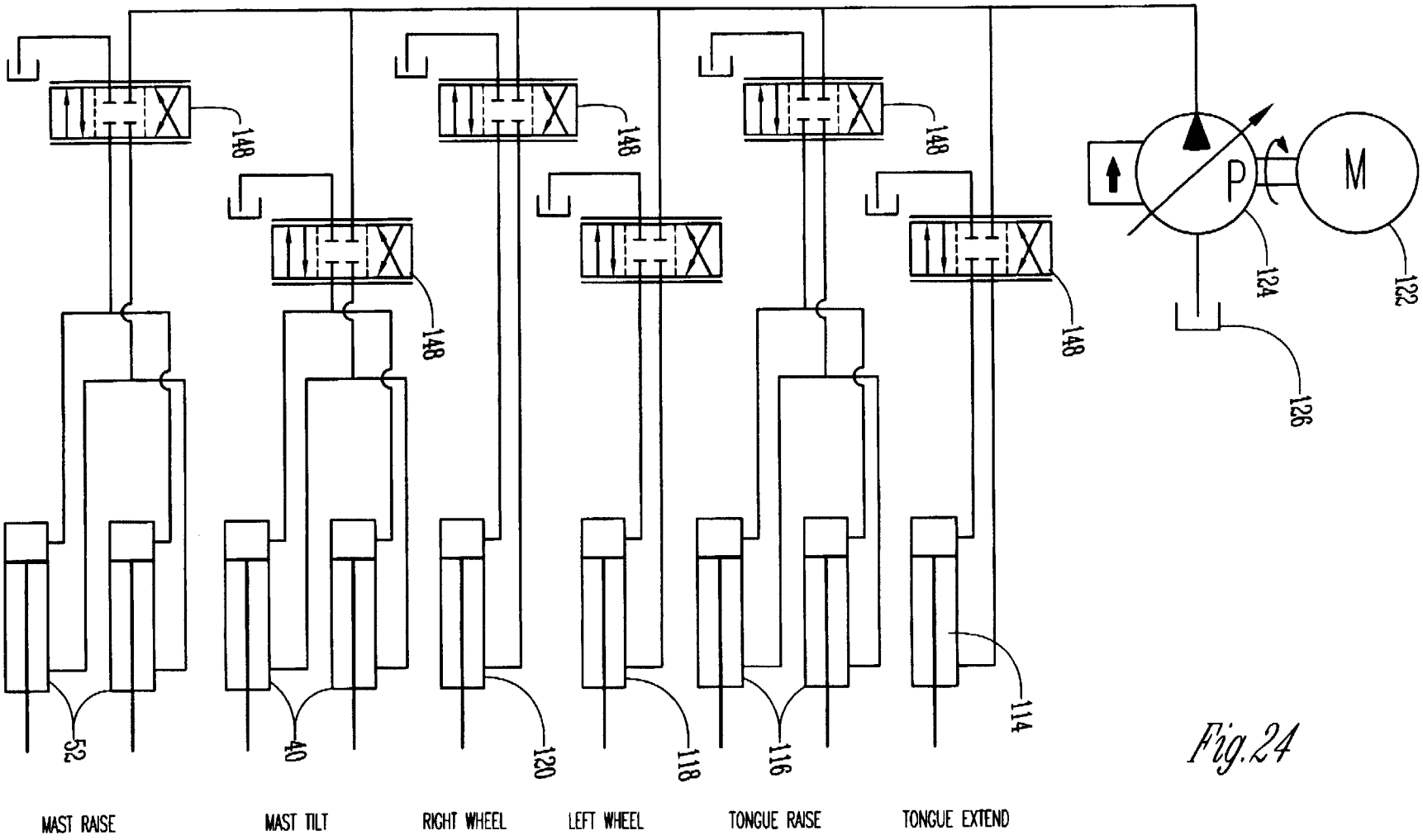
FIG. 24 is a schematic and diagrammatic view of a hydraulic control system that can be used with the embodiment of FIG. 12.

A gasoline powered motor 122 (Briggs and Stratton 16 horsepower V-twin-OHV Van Guard gas engine) has its output shaft attached to hydraulic pump 124 (shown diagrammatically at FIG. 24). A closed hydraulic fluid reservoir tank 126 is mounted with motor 122 and pump 124 to lower frame 16. A control bar 128 is attached to lower frame 16 and extends up to support a plurality of hydraulic control levers 130 that allow manual activation of hydraulic valves 148 (FIG. 24).

Appropriate hydraulic hoses interconnect the hydraulic elements so that device 100 is a self-contained, self-operating unit. Control levers 130 allow independent control of tongue extension cylinder 114, left wheel cylinder 118, and right wheel cylinder 120. Control levers 130 simultaneously control hydraulic cylinder pairs 116 for raising tongue 110, hydraulic cylinders 40 for tilting the mast, and hydraulic cylinders 52 for raising carriage 42.

In this embodiment, cylinders 114 and 116 are Lion 2500-8" stroke, 1⅛" shaft, 2.5" bore hydraulic cylinders (Winnipeg/Minneapolis). Cylinders 40 and 52 are energy hydraulic cylinders, Monticello, Iowa, 5" bore, 5' stroke and are double acting, pressure can be used to move the piston in each cylinder in either direction.

FIG. 24 is a schematic diagram of the hydraulic system of device 100. It is to be understood that in the disclosed embodiment, there are flow controls with line breaks to keep pressure on the cylinders at all times for safety reasons (not shown).

Figure 16:
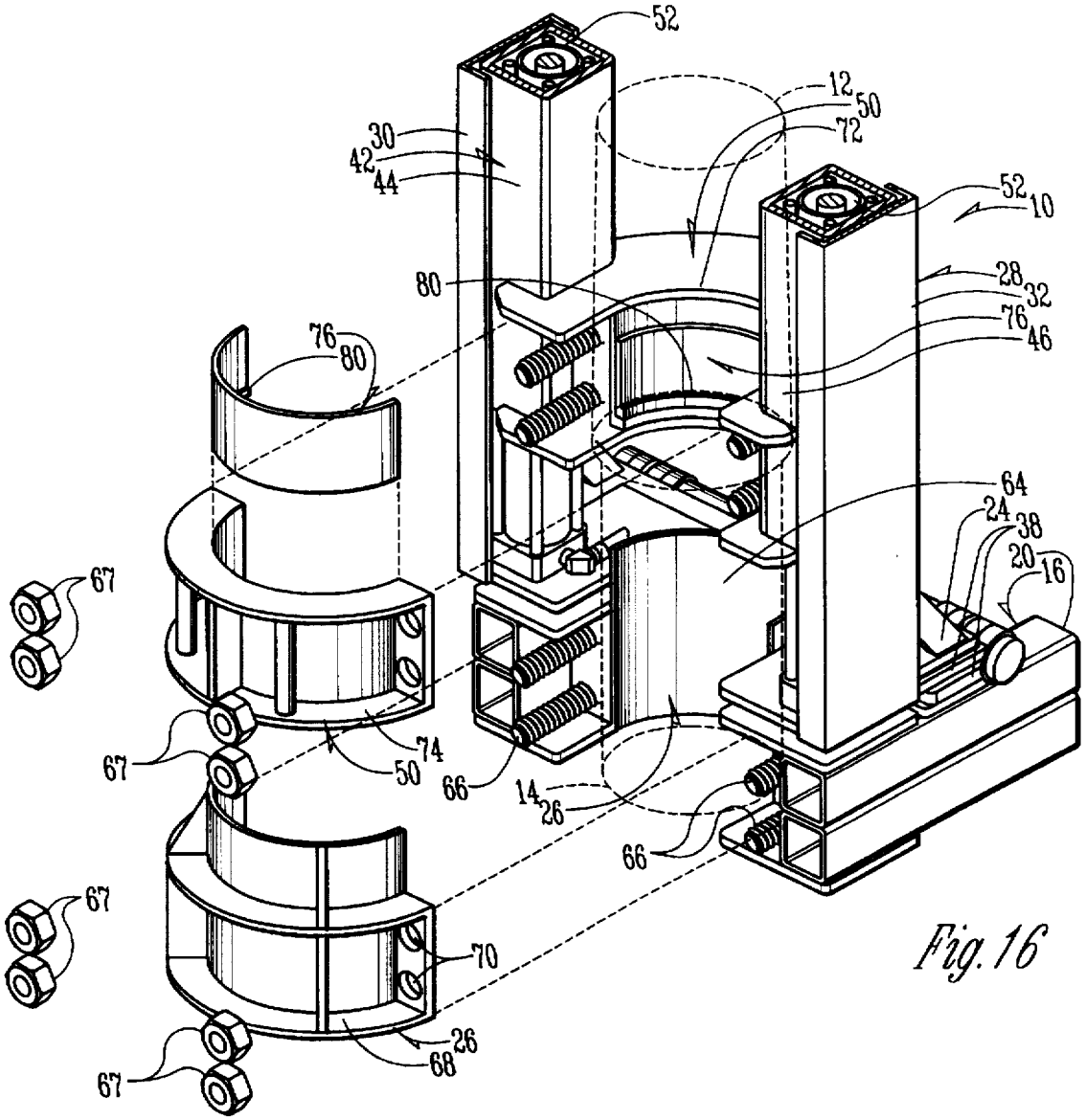
FIG. 16 is similar to FIG. 5 but shows the embodiment of FIG. 12.
Figure 14:
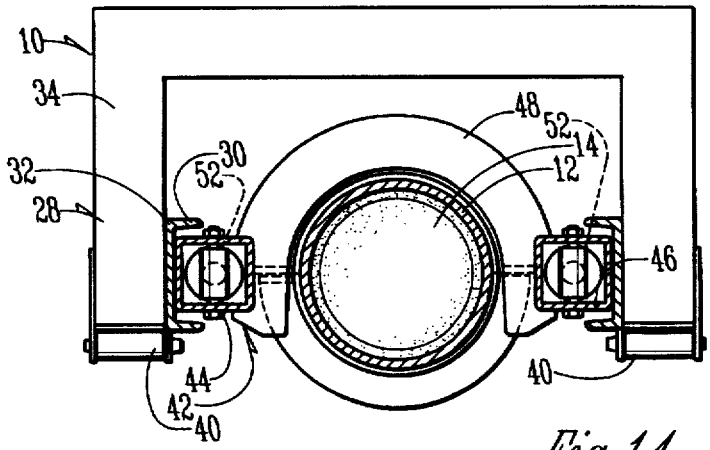
FIG. 14 is similar to FIG. 3 but shows the embodiment of FIG. 12.
Figure 15:
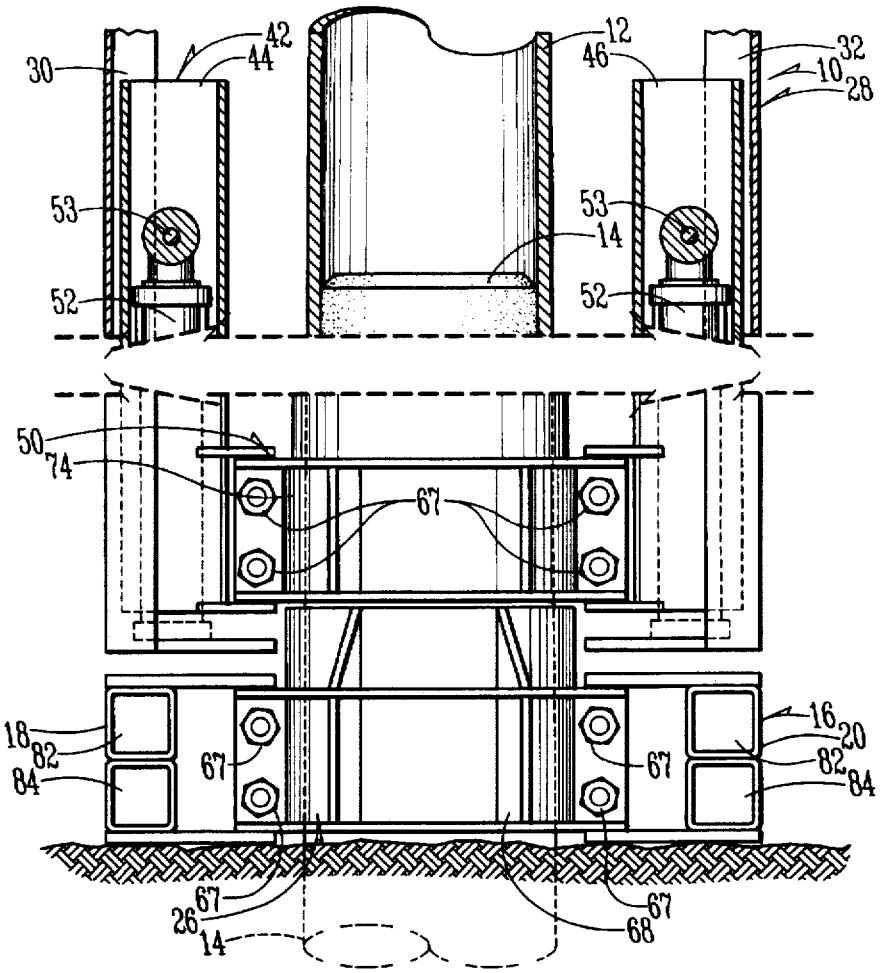
FIG. 15 is similar to FIG. 4 but shows the embodiment of FIG. 12.

FIG. 16 shows that device 10 uses less bolts than device 10 for attaching the removeable collar halves. In this embodiment bolts 66 are 1½" Acme (square) thread bolts with corresponding nuts 67. To facilitate attachment and disattachment of the removeable collar halves, hydraulic impact wrenches can be used. Such a wrench could be plumbed into the hydraulic pump. Alternatively, a manual wrench could be utilized. It is also to be understood that in device 10, rollers could be pivotably attached inside of the top ends of carriage 42 (see FIG. 4) to facilitate the smooth sliding of carriage 42 within the mast. In device 100, however, those rollers are not used and the top of cylinders 52 are simply pinned into place.

It can be appreciated that device 100 is easy to manipulate, position, and operate. This includes bringing it up to pole and base 12/14, and then finally adjusting its position relative to pole/base 12/14. The adjustability of the wheels and tongue can also help to dislodge pole 12 from base 14 or to prevent binding either when pole 12 is being removed or being inserted.

It would also be appreciated that the invention could take the form of being workable with other types of poles and bases. For example, in situations where a pole is bolted down to a base that is secured in the ground, a device according to the present invention could be configured so that it could be brought up to the base and pole, that some sort of collar or securing device could attach and/or grip the base, and then like the previously described embodiments, some other structure could cradle the pole. The nuts on the bolts could be removed to free the pole from the base and the device could then lift and tilt the pole. For example, another set of bolts could exist outside of the connection between the pole and the base. Those bolts could be used to attach the lower collar of the device according to the present invention. Upon removal of the nuts holding the pole to the base, the pole could be lifted relative to the base while still using the base as the stabilizing reference point. Other pole/base configurations are possible for use with the present invention.

Therefore it can be seen that the invention allows manipulation of a pole relative to a base without requiring special built-in structure in the pole and/or base such as internal hinges or gripping components which could weaken structural rigidity of the combination or require additional cost.

Any of the hydraulic cylinders can include a safety mechanism in case of loss of hydraulic pressure to the cylinders. An example would be a type of ball valve, known in the art, to lock the cylinder in place if pressure is lost. Therefore, for example, if cylinders 40 were lowering tower 32 and pole 10, and if pressure to the bottom side of cylinders 40 were lost, the ball valves would seat and hold the pressure in that side to prevent pole 10 from crashing down. Flow restricters can also be used, such as are known in the art.

What is claimed is:

1. A method for manipulating a pole relative to a base, where the pole has a top and a bottom, comprising:

gripping the base to create a stable reference;

cradling the pole; and moving the pole relative to the reference on the base while the pole is separated from the base for inspection and maintenance of the pole and any item suspended on the pole or installation of the pole on the base.

2. The method of claim 1 wherein the pole is cradled near the bottom of the pole.

3. The method of claim 1 further comprising pivoting the pole relative to the base while the pole is detached from the base.

4. The method of claim 3 further comprising holding the pole relatively horizontal but off the ground.

5. The method of claim 3 further comprising laying a portion of the pole on the ground.

6. The method of claim 1 wherein the pole has a hollow lower end which is slip fittable over a top end of the base.

7. The method of claim 6 wherein cradling of the pole includes gripping the hollow lower end of the pole.

8. An apparatus for manipulating a pole relative to a base which can be rigidly fixed in the ground and the pole is separable from the base comprising:

a frame;

a first connection mounted on the frame and connectable to the base;

a second connection mounted on the frame and connectable to the pole;

an actuator connected to the first and second connections, the actuator comprising at least one extendible and retractable member which can move the second connection both towards and away from the first connection; and so that using the first connection on the base as a reference, the pole can be moved relative to the base by operation of the actuator.

9. The apparatus of claim 8 wherein the first connection comprises a collar for gripping the base after the base is installed in the ground.

10. The apparatus of claim 9 wherein the collar comprises a first portion and second portion for clamping and rigidly securing the collar to the base.

11. The apparatus of claim 8 wherein the second connection comprises a collar.

12. The apparatus of claim 8 wherein the actuator comprises at least one hydraulic cylinder with an extendible arm.

13. The apparatus of claim 12 further comprising hoses connected between the hydraulic cylinder and a hydraulic motor.

14. The apparatus of claim 8 wherein the actuator comprises a hydraulic cylinder.

15. The apparatus of claim 8 wherein the actuator comprises two hydraulic cylinders positioned generally on opposite sides of the pole.

16. The apparatus of claim 8 further comprising pivot members at connection of the actuator to one of the first connection and second connection to allow pivoting of the pole with respect to the base once the pole is detached from the base.

17. The apparatus of claim 8 wherein the pole has a lower end and the second connection includes a member to grip underneath the lower end.

18. An apparatus to lift a pole having a bottom which connects to a base that includes a top that is secured in the ground, comprising:

a first collar detachably mountable to the base;

a second collar detachably mountable to the pole;

an extendible and retractable member connected between the first and second collars; and an actuator connected to the member to extend or contract the member between a position where the first and second collars are spaced apart sufficiently to hold the bottom of the pole above the top of the base, and a second position where the pole is seated onto the base.

19. The apparatus of claim 18 wherein the first and second collars are two pieces, each piece for surrounding approximately one-half of the base or pole.

20. The apparatus of claim 18 wherein the member comprises a frame attached to the first collar and a carriage which rides in the frame and which is attached to the second collar.

21. The apparatus of claim 18 wherein the actuator is a hydraulic cylinder.

22. The apparatus of claim 18 further comprising a pivoting mechanism attached to the member, allowing the member to be pivoted downwardly when the first collar is in a first position.

23. The apparatus of claim 18 further comprising a gripping member connected to the second collar to grip underneath the bottom of the pole.

24. A method of manipulating a pole relative to a base, where the base has an upper portion extending above the ground and a lower portion secured in the ground and the pole has a lower hollow portion which is separable from and can be slip fit onto or removed from the upper portion of the base, comprising:

gripping the upper portion of the base;

gripping the lower portion of the pole; and moving the lower portion of the pole relative to the base by exerting force relative to the base to either separate the pole from the base or slip a separated pole onto the base.

25. The method of claim 24 wherein the step of moving the pole relative to the base includes raising the pole to a height above the base and in a generally vertical position.

26. The method of claim 24 further comprising moving the pole to or from a non-vertical position when raised above the base.

* * * * *